United States Patent [19]

Takeuchi et al.

[11] 4,145,101

[45] Mar. 20, 1979

[54] METHOD FOR MANUFACTURING GAS INSULATED ELECTRICAL APPARATUS

[75] Inventors: Ryozo Takeuchi, Hitachi; Tatsuo Igawa, Kitaibaraki, both of Japan

[73] Assignee: Hitachi, Ltd., Japan

[21] Appl. No.: 674,083

[22] Filed: Apr. 6, 1976

[30] Foreign Application Priority Data

Apr. 18, 1975 [JP] Japan ..... 50-47274

[51] Int. Cl.[2] ..... H01J 9/00

[52] U.S. Cl. ..... 316/4; 316/13

[58] Field of Search ..... 316/4, 5, 7, 13; 204/168

[56] References Cited

U.S. PATENT DOCUMENTS

| | | | |
|---|---|---|---|
| 2,093,699 | 9/1937 | Varian et al. | 316/4 X |
| 3,423,684 | 1/1969 | Purser | 313/360 X |
| 3,553,410 | 1/1971 | Morva | 200/144 X |
| 3,619,701 | 11/1971 | Sugano | 313/222 |
| 3,723,289 | 3/1973 | Boom | 204/168 X |
| 3,733,521 | 5/1973 | Kalb | 315/36 X |
| 3,762,941 | 10/1973 | Hou | 204/168 X |
| 3,858,955 | 1/1975 | Sommer | 316/4 X |

*Primary Examiner*—Richard B. Lazarus

*Attorney, Agent, or Firm*—Craig & Antonelli

[57] ABSTRACT

A method of manufacturing gas insulated electrical apparatus wherein a charging portion of an electrical apparatus is disposed in a sealed chamber filled with an insulation gas, with the charging portion being insulated from the chamber, and conductive particles deposited on an inner wall surface of said sealed chamber and/or the surface of the charging portion, and conductive particles floating in the gas within the sealed chamber are adhered to the inner wall of the sealed chamber and/or the surface of the charging portion by insulation coating forming material. To this end, organic monomer gas is introduced into the sealed chamber for polymerizing the monomer gas by glow discharges.

24 Claims, 9 Drawing Figures

METHOD FOR MANUFACTURING GAS INSULATED ELECTRICAL APPARATUS

The present invention relates to an improvement in a method for manufacturing a gas insulated electrical apparatus.

$SF_6$ gas has excellent insulating and quenching capabilities and hence it has been widely used as an insulation medium in a high voltage electrical apparatus.

The above insulation gas is usually used by itself or with a small amount of $N_2$ gas. The electrical apparatus insulated by such insulation gas, such as gas insulated circuit breaker, gas insulated switch-gear apparatus, high voltage D.C. converter or the like, has its high voltage charging portion supported by appropriate supporting insulation means, in a sealed chamber. The above chamber is frequently a metallic tank usually connected to ground, but in some case the chamber may be insulated from the ground.

In the manufacturing process, the charging portion of the electrical apparatus is assembled to the chamber in an air-conditioned assembly room in order to avoid the pollution of dusts, humidity and especially metal particles to the chamber. However, it is almost impossible to remove completely micro conductive particles deposited on an inner wall surface of the chamber and/or surface of the electrical apparatus body. Such conductive particles float in the voltage-applied operating state of the electrical apparatus by virtue of electric field and the particles with charges reciprocate repeatedly between a high voltage electrode and the apparatus wall which serves as a ground electrode. In a D.C. electrical apparatus, the conductive particles are collected at either one of the high and low voltage electrodes. This results in noises similar to corona discharge and considerable concentration of electric field depending on the shape of the conductive particles, which results in substantial decrease in flashover voltage. Furthermore, when there are some surface of insulation materials between both electrodes, a flashover voltage is greatly reduced because the conductive particles continuously deposit on the surface of insulation materials.

It is an object of the present invention to provide a method for manufacturing a gas insulated electrical apparatus having a stable insulating ability and high reliability, by changing the conductive particles in the chamber into an inactive state.

It is another object of the present invention to provide a method for manufacturing a gas insulated electrical apparatus without reducing its flashover voltage.

It is still another object of the present invention to provide a method for manufacturing a gas insulated electrical apparatus without reducing surface flashover voltage of an insulation materials which insulates a high voltage charging portion of an electrical apparatus body.

According to the present invention, in order to accomplish the above objects, after the charging portion of the electrical apparatus body has been accomodated and assembled in the chamber, insulation coatings are formed on the inner wall surface of the container and the charging portion surface to adhere the conductive particles thereon. A predetermined time period after the charging portion has been assembled in the chamber and the latter has been sealed, the conductive particles which have been floating in the chamber deposit on the inner wall surface of the chamber, charging portion of the electrical apparatus body and an insulator which encircles the charging portion. In accordance with the present invention, under such condition the insulation coatings are formed on the inner wall of the chamber and the charging portion surface to adhere physically the conductive particles on those surfaces.

In forming the insulation coating, according to the present invention, after the electrical apparatus body has been assembled in the chamber and the latter has been sealed, the interior of the chamber is depressurized and thereafter organic monomer such as styrene, paraxylene, ethylene or the like is introduced in gaseous form into the chamber and a high voltage is applied across the chamber and the high voltage charging portion to produce a glow discharge therebetween. By means of the glow discharge, the gaseous monomer is polymerized through discharge polymerization reaction so that required insulation coating can be formed. After the formation of the insulation coating, the interior of the chamber is depressurized again and then $SF_6$ gas is charged to complete the gas insulated electrical apparatus.

According to one aspect of the invention, there is provided a method for manufacturing a gas insulated electrical apparatus having its charging portion mounted in and insulated from a sealed chamber filled with insulation gas, comprising the steps of housing and assembling the charging portion of the electrical apparatus in the chamber, evacuating air within the chamber after the completion of the assembling to decompress the interior of said chamber, introducing fluid insulation film forming material into the chamber, depositing the insulation film forming material on the inner wall of the chamber and/or on the surface of the charging portion through polymerization reaction to form insulation coating thereon, decompressing the interior of the chamber after the formation of the insulation coating, and introducing insulation gas into the chamber after the second decompression step and sealing the chamber.

According to another aspect of the invention there is provided a method for manufacturing a gas insulated electrical apparatus having its charging portion mounted in and insulated from a sealed chamber filled with insulation gas, comprising the steps of housing and assembling the charging portion of the electrical apparatus in the chamber, evacuating air within the chamber after the completion of the assembling to decompress the interior of the chamber, introducing fluid insulation film forming material into the chamber, applying a high voltage between the chamber and the charging portion to cause glow discharge to occur therebetween, whereby the insulation film forming material is deposited on the inner wall of the chamber and/or the surface of the charging portion through polymerization reaction to form insulation coating thereon, decompressing the interior of the chamber after the formation of the insulation coating, and introducing insulation gas into the chamber and sealing the chamber.

According to still another aspect of the invention, there is provided a method for manufacturing a gas insulated electrical apparatus having its charging portions mounted in and insulated from a sealed chamber filled with insulation gas, comprising the steps of housing and assembling the electrical apparatus in the chamber, the electrical apparatus having a plurality of charging portion surfaces having different insulation distances from the inner wall surface of the chamber, evacuating air within the chamber after the completion of the assembling to decompress the interior of the chamber, introducing fluid insulation film forming material into the chamber, applying a high voltage between the chamber and the charging portions to cause a glow discharge to occur therebetween, whereby the insulation film forming material is deposited on the inner wall of the chamber and/or the surfaces of the charging portions through polymerization reaction to form insulation coating thereon, decompressing the interior of the chamber after the formation of the insulation coating, and introducing insulation gas into the chamber and sealing the chamber.

According to yet another aspect of the invention, there is provided a method for manufacturing a gas insulated electrical apparatus having its charging portion mounted in and insulated from a sealed chamber filled with insulation gas, comprising the steps of housing and assembling the charging portion of the electrical apparatus in the chamber, decompressing the interior of the chamber to about $10^{-1}$ – $10^{-5}$ Torr. after the completion of the assembling, introducing gaseous monomer selected from the group consisting of styrene, para-xylene and ethylene into the chamber up to $10^{-3}$ – 20 Torr., applying a high voltage between the chamber and the charging portion to cause a glow discharge to occur therebetween, whereby the monomer is deposited on the inner wall of the chamber and/or the surface of the charging portion through polymerization reaction to form insulation coating thereon, decompressing the interior of the chamber to about $10^{-1}$ – $10^{-5}$ Torr. after the formation of the insulation coating, and introducing insulation gas into the chamber to more than 1 atmosphere and sealing the chamber.

The present invention will now be described in more detail in conjunction with preferred embodiments thereof shown in the accompanying drawings, in which.

Figure 5:
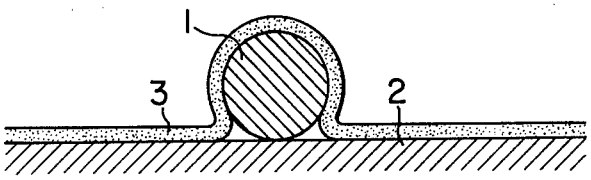
Figure 6:
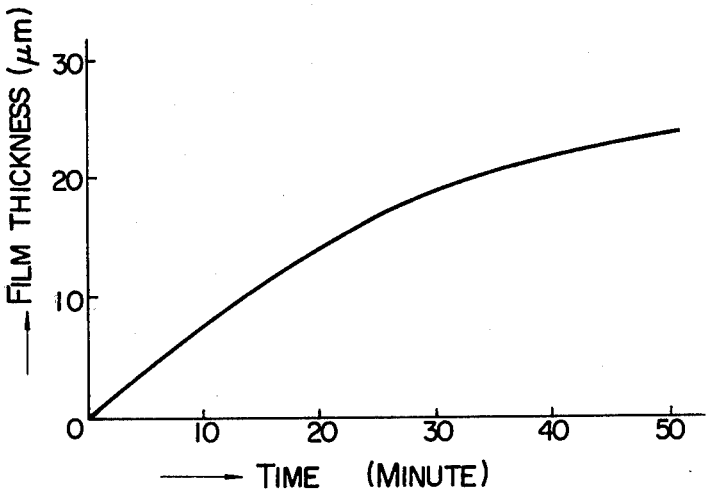
Figure 7:
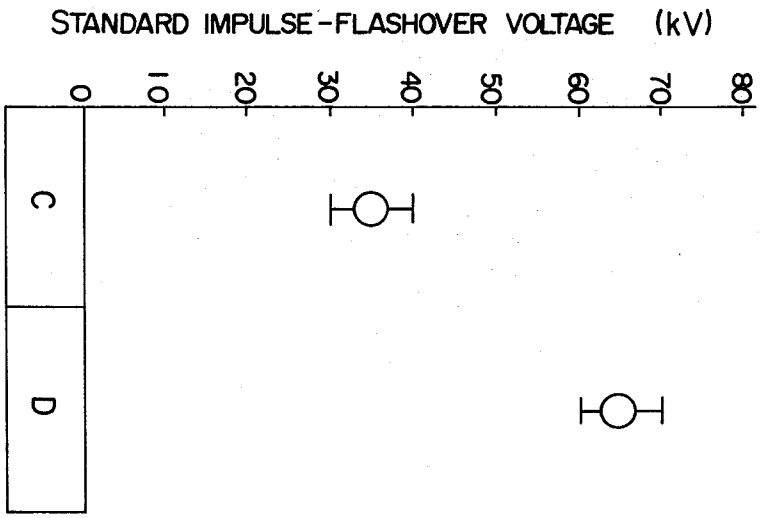

FIG. 4 including 4A, 4B and 4C illustrates the process of forming gaseous monomer into polymer by discharge polymerization;

FIG. 5 is a sectional view showing conductive particles adhered to the wall of the apparatus by organic insulation material film;

FIG. 6 is a characteristic diagram showing forming rate of the organic insulation material film; and FIG. 7 is a characteristic diagram showing the relationship between the presence and absence of the organic insulation material film and the insulation ability in the $SF_6$ gas.

The gas insulated electrical apparatus is generally housed in a sealed metallic chamber.

Figure 1:
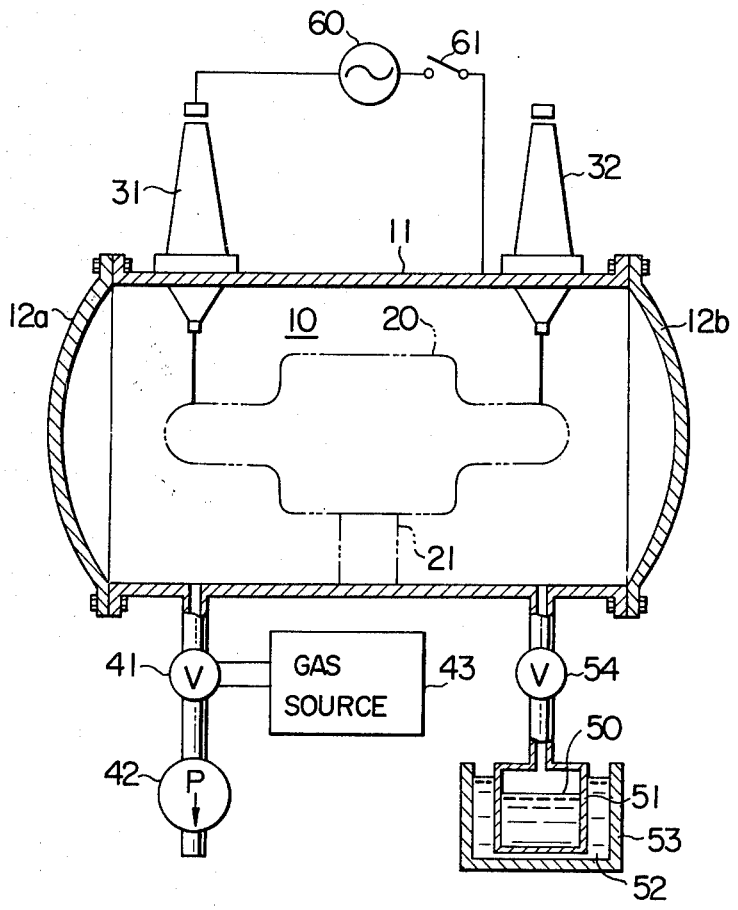
FIG. 1 illustrates manufacturing process of a gas insulated electrical apparatus in accordance with the present invention.

FIG. 1 shows a sealed chamber 10 comprising a cylinder body 11 having opposite open ends and lid plates 12*a* and 12*b* for hermetically sealing the open ends. Housed in the chamber 10 is an electrical apparatus body 20, which is supported within the chamber 10 by an appropriate member such as an insulating support 21 molded of epoxy resin. The chamber 10 is hermetically equipped with a pair of terminal bushings 31 and 32 which serve as external lead terminals for the electrical apparatus body 20. The assembling of the electrical apparatus body 20 into the chamber 10 is carried out with the lid plates 12*a* and 12*b* are being removed.

The conductive particles which exert a significant effect on to the insulation ability deposit on the parts of the gas insulated electrical apparatus body 20 or they are produced by rubbing of metals during assembling, and they are brought into the sealed chamber 10. It is impossible to remove the conductive particles thus brought into the sealed chamber 10. Therefore, unless the floating of the conductive particles is prevented, the breakdown voltage in the gas is substantially decreased.

Figure 2:
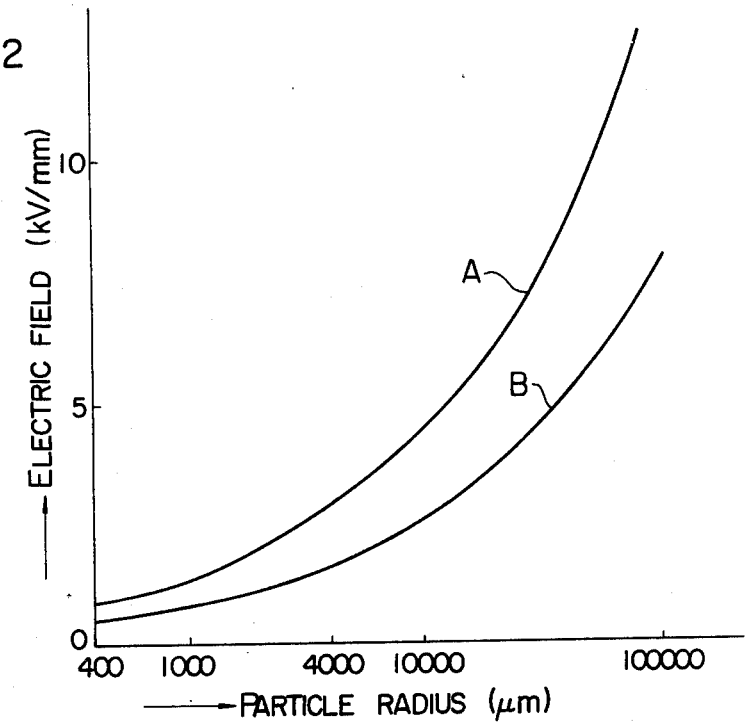
FIG. 2 is a characteristic diagram showing stray electric field of conductive particles.

The conductive particles are charged on the wall of the sealed chamber 10 and floated by the action of electric field. FIG. 2 shows stray electric field of the conductive particles for spherical particles in which A represents a characteristic curve for iron particles and B for aluminum particles. It is seen from FIG. 2 that the conductive particles float under very low electrical field. The floating particles are attracted to high electric field region, which, together with the electric field concentration by the particle, leads to insulation breakdown at an extremely low voltage. However, if the conductive particles which is floated by the electric field are adhered to the wall of the apparatus, the floating thereof can be readily prevented.

One method of adhering the conductive particles on the wall of the apparatus is to apply high viscosity paint on the surface of the apparatus and the parts before assembling. This method, however, is practically not applicable because it makes the assembling difficult and provides poor working efficiency.

In a preferred embodiment of the present invention, after the parts have been assembled in the chamber 10, monomer such as styrene, para-xylene, ethylene or the like (hereinafter referred to as film forming material) in gaseous form is charged into the chamber 10 to the extent of $10^{-3}$ – 20 Torr, which gas is then ionized through glow discharges for bombardment against metal surface or insulation material surface to polymerize the monomer for forming organic film.

Referring to FIG. 1, a switch valve 41 is connected to the chamber 10, one port of the value being connected to a vacuum pump 42 while the other port being connected to an $SF_6$ gas source 43. Monomer 50 which constitutes the film forming material is sealed in a chamber 51 which is housed in a cooling bath 53 filled with coolant 52. The monomer 50 in the chamber 51 can be introduced into the chamber 10 through a stop valve 54. In order to generate glow discharges between the electrical apparatus body 20 housed in the chamber 10 and the inner wall of the chamber 10, a high voltage is supplied between the terminal bushing, e.g. 31 and the chamber 10 by a high voltage supply 60 through a switch 61.

Figure 3:
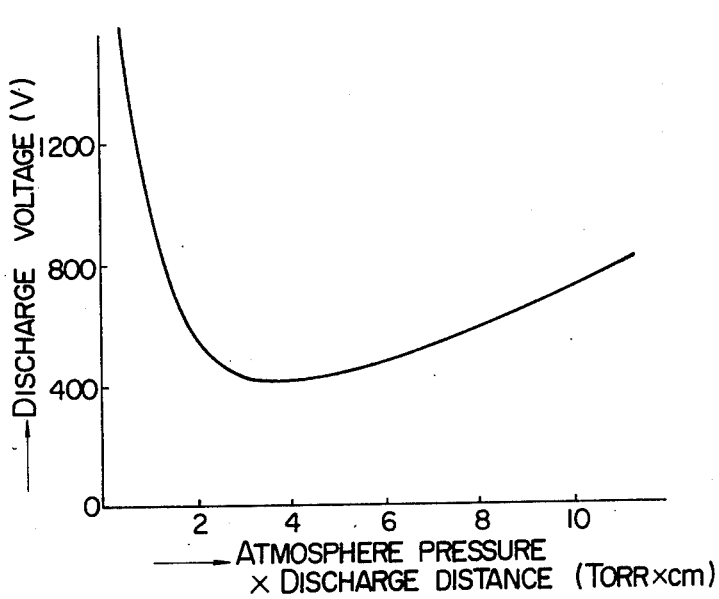
FIG. 3 is a characteristic diagram showing relationships between discharge voltage and atmosphere pressure and discharge distance.

According to the above method, since the film forming material is introduced in gaseous form into the sealed chamber 10, the film forming material can be dispersed uniformly in the chamber 10. In this case, however, the glow discharge should also occur uniformly in the chamber 10. The discharge distance of the glow discharge changes with the atmosphere pressure. This is apparent from FIG. 3 which shows the relationship between discharge voltage and atmosphere pressure and discharge distance. Namely, if the gaseous film forming material is introduced into the chamber such that the pressure in the chamber gradually changes from low pressure to high pressure, or if the applied voltage is gradually changed while maintaining the gas pressure at a constant value, the glow discharges can occur everywhere in the chamber. The discharge does not occur at an area where the film has been formed, and the discharge is shifted to other area.

Figure 4A:
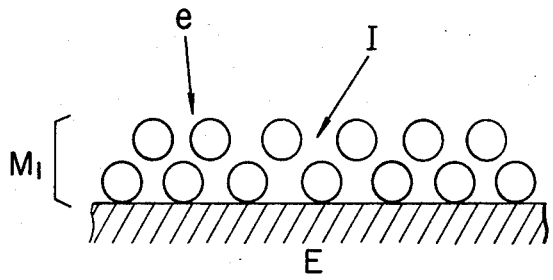
Figure 4B:
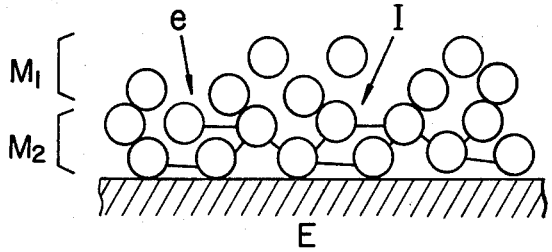
Figure 4C:
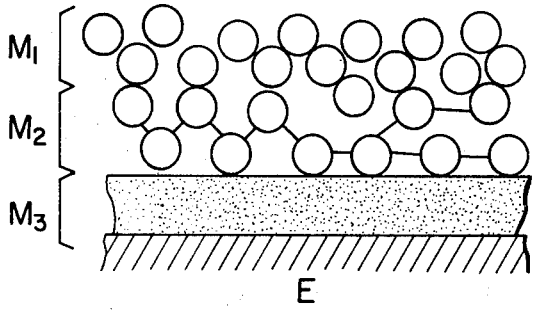

FIG. 4 illustrates mechanism of discharge polymerization. When electron e or ion I bombards to a group of gas molecules $M_1$ which are absorbed on an apparatus wall E as shown in FIG. 4A, the group of gas molecules $M_1$ conducts monomer polymerization reaction to produce a monomer polymerization reaction layer $M_2$ as shown in FIG. 4B. In this manner, a polymerization film $M_3$ is formed on the apparatus wall E through the above reaction, as shown in FIG. 4C.

By coating the apparatus wall with the organic insulation film in the manner described above, the conductive particle 1 can be adhered to the apparatus wall 2 by the organic insulation film 3, as shown in FIG. 5.

This process can be practiced in the following manner. First, the gas insulated electrical apparatus is assembled and then the inside of the chamber 10 is maintained in reduced pressure condition in the order of $10^{-1}$ - $10^{-5}$ Torr. by means of a vacuum pump 42, and it is dried. Thereafter, the vacuum pump 42 is deenergized or the valve 41 is closed and A.C. (including H.F.) or D.C. power is supplied to the wall of the chamber 10 and the terminal bushing 31. Under this condition, the valve 54 is opened to introduce slowly the gaseous film forming material into the chamber 10. Thus the pressure in the chamber 10 increases slowly so that glow discharges occur everywhere in the chamber 10 in accordance with the characteristic shown in FIG. 3, resulting in the formation of the organic insulation film everywhere.

The formation rate of the organic insulation film is shown in FIG. 6, which shows data taken for the film forming area of 10 $cm^2$. The formation rate decrease with the increase of the film forming area in the chamber. Therefore, the gaseous film forming material should be introduced at a rate corresponding to the film forming rate. Preferably the process of forming the organic insulation film is repeated several times.

After the film forming process, the interior of the chamber is depressurized again to $10^{-1}$ - $10^{-5}$ Torr., and $SF_6$ gas to be used as insulation medium is introduced into the chamber up to a predetermined pressure, and then the chamber is sealed.

Test results of the effect of the above treatment mode for an electrode box including solid insulation rod are given in Table 1 below.

Table 1

| Condition | D.C. insulation Breakdown Voltage (in KV) |
|---|---|
| Conductive particles included. No treatment. | 22.0 ± 10 |
| Conductive particles included. With treatment. | 46.0 ± 5 |
| No conductive particle. | 47.0 ± 5 |

From the above Table 1 it is apparent that the insulation ability which is comparable to that where no conductive particle is included is obtainable by conducting the above processing.

FIG. 7 shows comparative data of standard impulse-flashover voltage (kV) for an article treated according to the present invention and an article not treated. The article tested each had a pair of hemispherical rods having a diameter of 5 mm opposing to each other with a gap of 2 mm. They were placed in $SF_6$ gas of 1 atmosphere and impulse voltages were applied for the measurement of discharge characteristics. The test results showed that the article (C) not treated according to the present invention exhibited discharge at 35 ± 5 kV while the article (D) treated in accordance with the present invention did not exhibit discharges until at 65 ± 5 kV.

As described hereinabove, according to the present invention, there is provided a method for manufacturing a gas insulated electrical apparatus having its charging portion mounted in a sealed chamber and insulated therefrom which chamber is filled with insulation gas, wherein after the charging portion has been accomodated and assembled in the chamber, fluid insulation film forming material is introduced into the chamber to form insulation coating on inner surface of the chamber, which coating serves to the inner surface of the chamber, which coating serves interior of the chamber is depressurized, insulation gas is introduced into the chamber, and the chamber is sealed. In this manner, the conductive particles brought into the sealed chamber can be readily adhered to the inner surface of the chamber to prevent floating of them, without sacrificing the efficiency of the assembling. In this way, a stable insulation ability which is comparable to that where no conductive particle is included is assured, enhancing the reliability of the gas insulated electrical apparatus.

What is claimed is:

1. A method for manufacturing a gas insulated electrical apparatus having an electrical apparatus body to which a high voltage is to be applied, a sealed chamber enclosing said apparatus body and filled with electrical-insulation gas, and an electrical insulation support member for supporting said apparatus body within said chamber and electrically insulating said apparatus body from said chamber, comprising the steps of:

(a) assembling said gas insulated electrical apparatus;
(b) evacuating air from within said chamber after the completion of said assembling step (a) to reduce the internal pressure of said chamber;
(c) introducing fluid electrical-insulating film forming material into said chamber;
(d) depositing said electrical-insulation film forming material on the inner wall of said chamber and on the surface of said apparatus body through a polymerization reaction to form an electrical-insulation film coating thereon;
(e) reducing the internal pressure of said chamber after the formation of said electrical-insulation film coating;
(f) introducing an electrical-insulation gas into said chamber after said internal pressure reducing step (e); and
(g) sealing said chamber.

2. A method for manufacturing a gas insulated electrical apparatus according to claim 1, wherein said step (d) of forming said electrical-insulation coating is repeated several times.

3. A method for manufacturing a gas insulated electrical apparatus according to claim 1, wherein said fluid electrical insulation film forming material is ethylene gas.

4. A method for manufacturing a gas insulated electrical apparatus according to claim 1, wherein said fluid electrical insulation film forming material is para-xylene gas.

5. A method for manufacturing a gas insulated electrical apparatus according to claim 1, wherein said fluid electrical insulation film forming material is styrene gas.

6. A method for manufacturing a gas insulated electrical apparatus having an electrical apparatus body to which a high voltage is to be applied, a sealed chamber enclosing said apparatus body and filled with electrical-insulation gas, and an electrical insulation support member for supporting said apparatus body within said chamber and electrically insulating said apparatus body from said chamber, comprising the steps of:

(a) assembling said gas insulated electrical apparatus;
(b) evacuating air from within said chamber after the completion of said assembling step (a) to reduce the internal pressure of said chamber;
(c) introducing fluid electrical-insulation film forming material into said chamber;
(d) applying a high voltage between said chamber and said apparatus body to cause a glow discharge to occur therebetween, whereby said electrical-insulation film forming material is deposited on the inner wall of said chamber and the surface of said apparatus body through a polymerization reaction to form an electrical-insulation film coating thereon;
(e) reducing the internal pressure of said chamber after the formation of said electrical-insulation film coating;
(f) introducing an electrical-insulation gas into said chamber after said internal pressure reducing step (e); and
(g) sealing said chamber.

7. A method for manufacturing a gas insulated electrical apparatus according to claim 6, wherein said fluid electrical insulation film forming material is styrene gas.

8. A method for manufacturing a gas insulated electrical apparatus according to claim 6, wherein said fluid electrical insulation film forming material is para-xylene gas.

9. A method for manufacturing a gas insulated electrical apparatus according to claim 6, wherein said fluid electrical insulation film forming material is ethylene gas.

10. A method for manufacturing a gas insulated electrical apparatus according to claim 6, wherein a source of high voltage supply for causing said glow discharge is an H.F. source.

11. A method for manufacturing gas insulated electrical apparatus having an electrical apparatus body to which a high voltage is to be applied, a sealed chamber enclosing said apparatus body and filled with electrical-insulation gas, and an electrical insulation support member for supporting said apparatus body within said chamber and electrically insulating said apparatus body from said chamber, comprising the steps of:

(a) assembling said electrical apparatus body in said chamber, said electrical apparatus body having a plurality of surfaces having different insulation distances from the inner wall surface of said chamber;
(b) evacuating air from within said chamber after the completion of said assembling step (a) to reduce the internal pressure of said chamber;
(c) introducing fluid electrical-insulating film forming material into said chamber;
(d) applying a high voltage between said chamber and said electrical apparatus body having a plurality of surfaces to cause a glow discharge to occur therebetween, whereby said electrical-insulation film forming material is deposited on the inner wall of said chamber and on said surfaces through a polymerization reaction to form an electrical-insulation film coating thereon;
(e) reducing the internal pressure of said chamber after the formation of said electrical-insulation film coating;
(f) introducing an electrical-insulation gas into said chamber after said internal pressure reducing step (e); and
(g) sealing said chamber.

12. A method for manufacturing a gas insulated electrical apparatus according to claim 11, wherein said high voltage for causing a glow discharge is gradually changed in magnitude while maintaining a gaseous pressure of said film forming material at a constant value to form said electrical-insulation film on a charging portion surface and on an inner wall surface facing said charging portion surface.

13. A method for manufacturing a gas insulated electrical apparatus according to claim 11, wherein a high voltage supply for causing said glow discharge is a commercial frequency power supply.

14. A method for manufacturing a gas insulated electrical apparatus according to claim 11, wherein a high voltage supply for causing said glow discharge is an H.F. power supply.

15. A method for manufacturing a gas insulated electrical apparatus according to claim 11, wherein a high voltage supply for causing said glow discharge is a D.C. power supply.

16. A method for manufacturing a gas insulated electrical apparatus according to claim 11, wherein said fluid electrical insulation film forming material is styrene gas.

17. A method for manufacturing a gas insulated electrical apparatus according to claim 11, wherein said fluid electrical insulation film forming material is para-xylene gas.

18. A method for manufacturing a gas insulated electrical apparatus according to claim 11, wherein said fluid electrical insulation film forming material is ethylene gas.

19. A method for manufacturing a gas insulated electrical apparatus having an electrical apparatus body to which a high voltage is to be applied, a sealed chamber enclosing said apparatus body and filled with electrical-insulation gas, and an electrical insulation support member for supporting said apparatus body within said chamber and electrically insulating said apparatus body from said chamber, comprising the steps of:

(a) assembling said gas insulated electrical apparatus body;
(b) reducing the internal pressure of said chamber to about $10^{-1}$ - $10^{-5}$ Torr. after the completion of said assembling step (a);
(c) introducing a gaseous monomer selected from the group consisting of styrene, para-xylene and ethylene into said chamber at a pressure up to $10^{-3}$ - 20 Torr.;
(d) applying a high voltage between said chamber and said electrical apparatus body to cause a glow discharge to occur therebetween, whereby said monomer is deposited on the inner wall of said chamber and the surface of said electrical apparatus body through a polymerization reaction to form an electrical-insulation film coating thereon;

(e) reducing the internal pressure of said chamber to about $10^{-1}$ - $10^{-5}$ Torr. after the formation of said electrical-insulation film coating of step (d);

(f) introducing an electrical-insulation gas into said chamber up to a pressure greater than 1 atmosphere; and (g) sealing said chamber.

20. A method for manufacturing a gas insulated electrical apparatus according to claim 11, wherein said high voltage for causing a glow discharge is maintained at a constant value while slowly increasing a gaseous pressure of said film forming material introduced into said chamber to form said electrical-insulation film on a charging portion surface and on an inner wall surface facing said charging portion surface.

21. A method for manufacturing a gas insulated electrical apparatus according to claim 1 wherein said electrical-insulation gas is sulfur hexafluoride or a mixture of sulfur hexafluoride and a small amount of nitrogen.

22. A method for manufacturing a gas insulated electrical apparatus according to claim 6 wherein said electrical-insulation gas is sulfur hexafluoride or a mixture of sulfur hexafluoride and a small amount of nitrogen.

23. A method for manufacturing a gas insulated electrical apparatus according to claim 11 wherein said electrical-insulation gas is sulfur hexafluoride or a mixture of sulfur hexafluoride and a small amount of nitrogen.

24. A method for manufacturing a gas insulated electrical apparatus according to claim 19 wherein said electrical-insulation gas is sulfur hexafluoride or a mixture of sulfur hexafluoride and a small amount of nitrogen.

* * * * *